US005240277A

United States Patent [19]

Scheulderman

[11] Patent Number: 5,240,277

[45] Date of Patent: Aug. 31, 1993

[54] WHEELCHAIR

[75] Inventor: Petrus J. Scheulderman, Almere, Netherlands

[73] Assignee: Richard van Seenus Nederland B.V., At Almere, Netherlands

[21] Appl. No.: 880,241

[22] Filed: May 7, 1992

[30] Foreign Application Priority Data

May 8, 1991 [NL] Netherlands ..... 9100789

[51] Int. Cl.[5] ..... A61G 5/02

[52] U.S. Cl. ..... 280/650; 280/250.1; 297/325

[58] Field of Search ..... 280/250.1, 304.1, 650, 280/658, 643, 648, 657; 297/325, 329

[56] References Cited

U.S. PATENT DOCUMENTS 4,555,121 11/1985 Lockard ..... 280/30
4,614,246 9/1986 Masse ..... 180/6.5
5,011,175 4/1991 Nicholson et al. ..... 280/650

FOREIGN PATENT DOCUMENTS 553088 3/1983 Australia .
0200223 12/1986 European Pat. Off. ..... 280/250.1
0329002 8/1989 European Pat. Off. .
0420263 4/1991 European Pat. Off. .
2532485 2/1977 Fed. Rep. of Germany .
8600778 1/1986 Fed. Rep. of Germany .
2089204 6/1982 United Kingdom .

*Primary Examiner*—David M. Mitchell
*Attorney, Agent, or Firm*—Lorusso & Loud

[57] ABSTRACT

A wheelchair comprises a base frame section with four wheels and a seat frame section for supporting a seat and a back rest. At both sides of the wheelchair front and back rods are pivotably connected with the base frame section and the seat frame section, wherein an adjusting means is mounted between both said frame sections for adjusting the seat angle between minimum and maximum values. The front and back rods are directed obliquely towards each other at the minimum seat angle. At the minimum seat angle the back rods enclose an angle with the vertical which is substantially greater than the angle enclosed between the front rods and the vertical, wherein the front rods pass the vertical when adjusting the seat angle from the minimum value to the maximum value.

5 Claims, 4 Drawing Sheets

WHEELCHAIR

BACKGROUND OF THE INVENTION

The invention relates to a wheelchair comprising a base frame section with four wheels and a seat frame section for supporting a seat and a back rest, wherein at both sides of the wheelchair front and back rods are pivotably connected with the base frame section and the seat frame section, wherein an adjusting means is mounted between both said frame sections for adjusting the seat angle between minimum and maximum values, wherein at the minimum seat angle the front and back rods are directed obliquely towards each other.

Such a wheelchair is known for example from EP-A-O 329 002. At the minimum seat angle of this known wheelchair the front rods enclose an angle with the vertical which is substantially larger than the angle enclosed by the back rods with the vertical. Thereby the front side of the wheelchair will make a relatively large movement in vertical direction during adjustment of the seat angle, whereas the movement in horizontal direction is small. Because during this adjustment of the seat angle the back rest also pivots backwardly, the centre of gravity will become located in a less favourable position during the adjustment of the seat angle, whereas the upward movement of the front side of the wheelchair is not so pleasant for the user of the wheelchair.

The invention aims to provide a wheelchair of the above-mentioned type, wherein these disadvantages are obviated in an effective manner while maintaining a compact construction.

SUMMARY OF THE INVENTION

To this end the wheelchair of the invention is characterized in that at the minimum seat angle the back rods enclose an angle with the vertical which is substantially greater than the angle enclosed between the front rods and the vertical, wherein the front rods pass the vertical when adjusting the seat angle from the minimum value to the maximum value.

In this manner it is obtained that during adjustment of the seat angle the height of the front side of the seat frame section hardly varies, whereas a relatively large movement in horizontal and forward direction occurs. Thereby the centre of gravity of the wheelchair remains located within the wheelbase of the wheelchair in a favourable manner so that the wheelchair remains stable at any seat angle. Moreover a pleasant seat position for the user is maintained with a substantially equal height of the front side of the wheelchair in all positions.

According to a favourable embodiment of the wheelchair of the invention the seat frame section carries on both sides a foot support detachably coupled with the seat frame section.

In this case it is preferred that each foot support comprises a coupling part and a carrier for a foot and/or leg support plate, wherein the coupling part is detachably coupled with the seat frame section and the carrier is pivotably connected with the coupling part, wherein an extension mechanism is mounted between the carrier and the coupling part, said extension mechanism extending the distance between the foot support plate and the coupling part when pivoting the carrier.

In this manner it is obtained that sufficient space for the legs of the user remains available between the foot support plate and the seat during pivoting the carrier.

BRIEF DESCRIPTION OF THE DRAWING

The invention will be further explained by reference to the drawings in which an embodiment of the wheelchair of the invention is schematically shown.

DETAILED DESCRIPTION OF A PREFERRED EMBODIMENT

Figure 1:
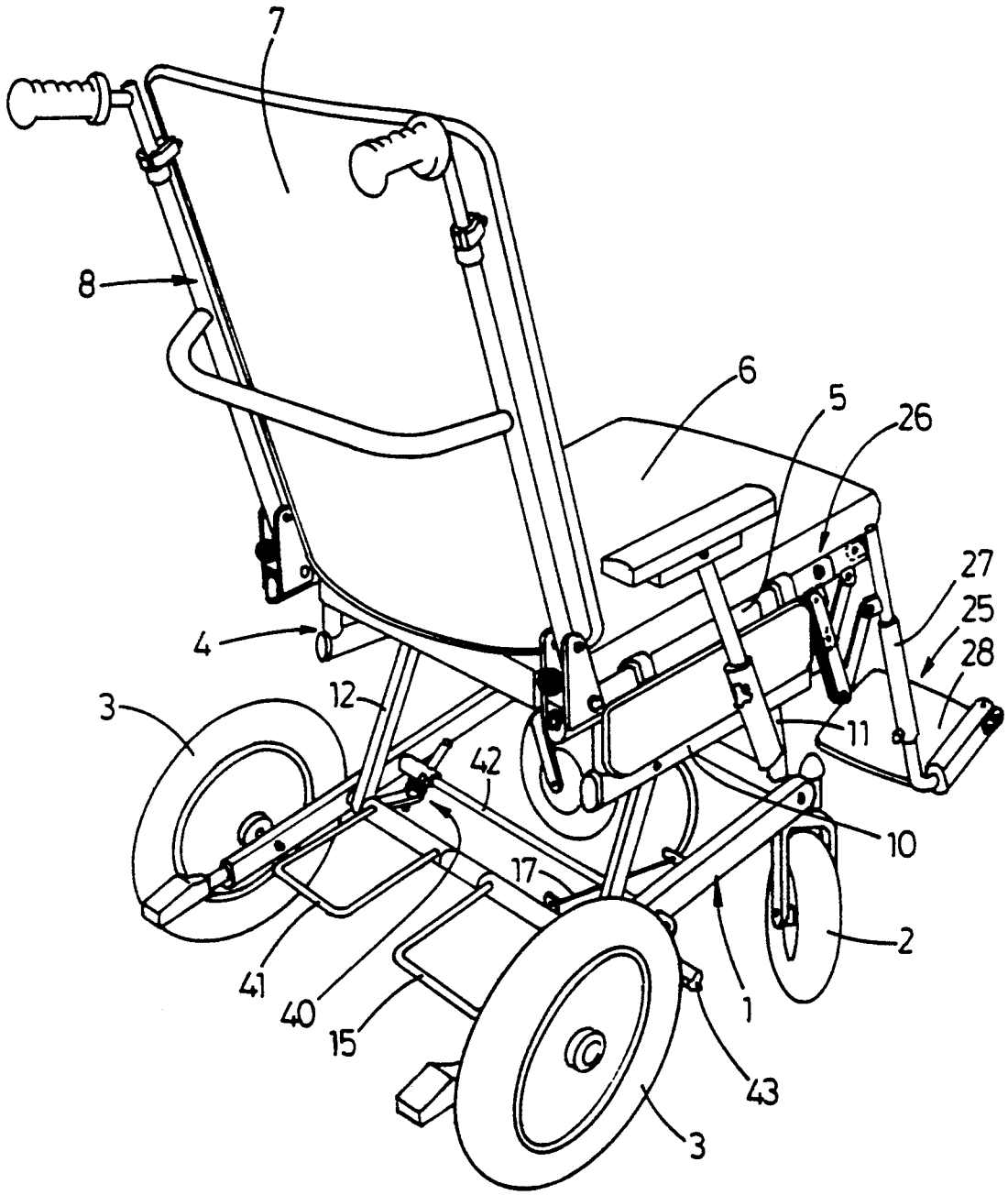
FIG. 1 shows a perspective view of an embodiment of the wheelchair of the invention.

In FIG. 1 there is shown a perspective view of a wheelchair comprising a base frame section 1 with two swivel castors 2 at the front side and two wheels 3 at the back side. Further the wheelchair comprises a seat frame section 4 supporting a seat 6 on upper side rods 5 on both sides, whereas a back rest 7 with a back rest frame section 8 is detachably coupled with these side rods 5 in a manner not further described.

Figure 3:
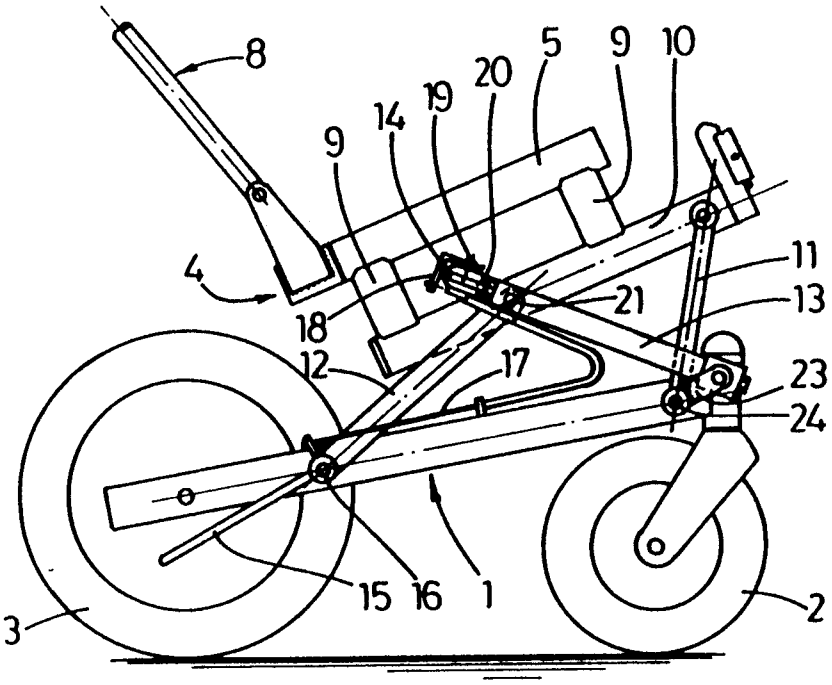
FIG. 3 shows a side view corresponding with FIG. 2, wherein the seat frame section is adjusted at the maximum seat angle.
Figure 2:
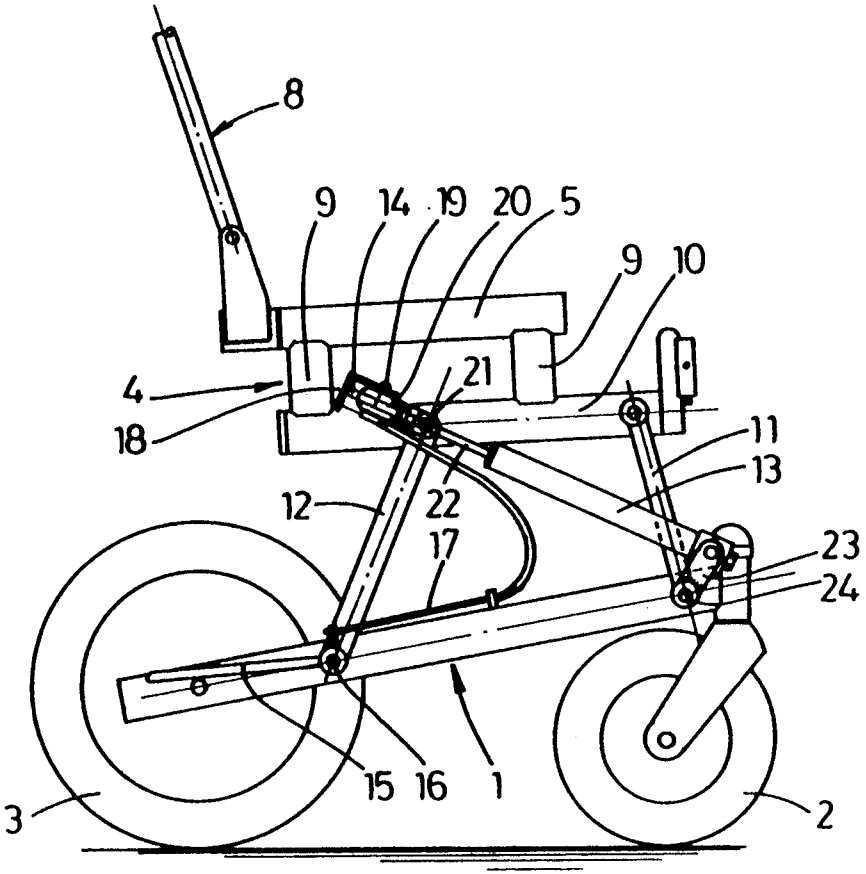
FIG. 2 is a partially shown side view of the wheelchair of FIG. 1, wherein the seat frame section is adjusted at a minimum seat angle.

As further indicated in the side views of FIGS. 2 and 3, the upper side rods 5 are connected with lower side rods 10 of the seat frame section 4 by supports 9. Between the base frame section 1 and the lower side rods 10 of the seat frame section 4 front and back rods 11 and 12 respectively, are pivotably mounted on both sides of the wheelchair, so that the seat frame section 4 has a seat angle adjustable between the minimum value shown in FIG. 2 of for example approximately 0° and the maximum value shown in FIG. 3 of for example approximately 30°. The seat angle of the seat 6 can be fixed in each position by an adjustment means which in the embodiment shown comprises a gas spring 13 known per se with a lock assembly not further shown, the operating pin 14 of which is shown in FIG. 2.

In the drawing it is clearly shown that with the minimum seat angle the back rods 12 enclose an angle with the vertical which is substantially greater than the angle enclosed by the front rods with the vertical, wherein with the minimum seat angle the front and back rods 11, 12 extend obliquely towards each other (see FIG. 2). When the seat angle of the seat 6 is adjusted from the minimum to the maximum value, the front rods 11 pass the vertical as clearly appears from a comparison of FIGS. 2 and 3. The back rods 12 on the other hand enclose an increasing angle with the vertical. Thereby the seat frame section 4 moves in the direction of the front wheels 2 during adjusting the seat angle to a greater value, whereby the centre of gravity of the wheelchair remains located within the wheelbase of the wheelchair in a favourable manner and therefore the wheelchair as a unit remains stable. Moreover the front side of the seat frame section 4 moves hardly upwardly during this adjustment of the seat angle, which guarantees the maintenance of a pleasant seat position for the user and further prevents a less aesthetic view on the user of the wheelchair for surrounding persons.

The operation of the operating pin 14 of the gas spring 13 occurs by means of a foot pedal 15 pivotably mounted on a cross shaft 16 of the base frame section 1. The foot pedal 15 is connected by a cable 17 with a lever 18 engaging the operating pin 14. The lever 18 is pivotably mounted at 19 on an oval cross rod 20 which is mounted pivotably around an axis 21 between the lower side rods 10 of the seat frame section 4. The piston pin 22 of the gas spring 13 is mounted in this oval cross rod 20 and the other end of the gas spring 13 is rotatably connected with supports 23 which are fixed on a cross shaft 24 by means of which the front rods 11 are pivotably mounted in the base frame section 1. At the minimum seat angle these supports 23 are located at the same side of the vertical as the back rods 12. Because the gas spring 13 is mounted between the oval cross rod 20 and the supports 23 in this manner, the seat angle of the seat frame section 4 can be varied in a larger range than the stroke of the piston pin 22 of the gas spring 13 would allow.

It will be clear that the seat angle of the seat frame section 4 can be adjusted in any position between the positions shown in FIGS. 2 and 3, respectively, by locking the gas spring 13.

Figure 4:
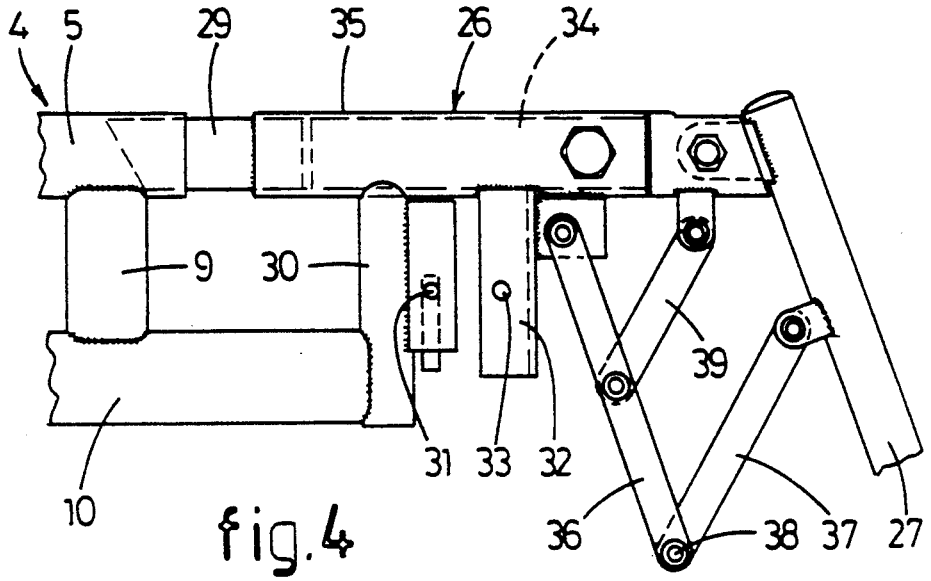
FIG. 4 is a partially shown side view of the coupling part and the carrier of a foot support, wherein the coupling part is detached from the seat frame section and the carrier is pivoted fully downwardly.
Figure 5:
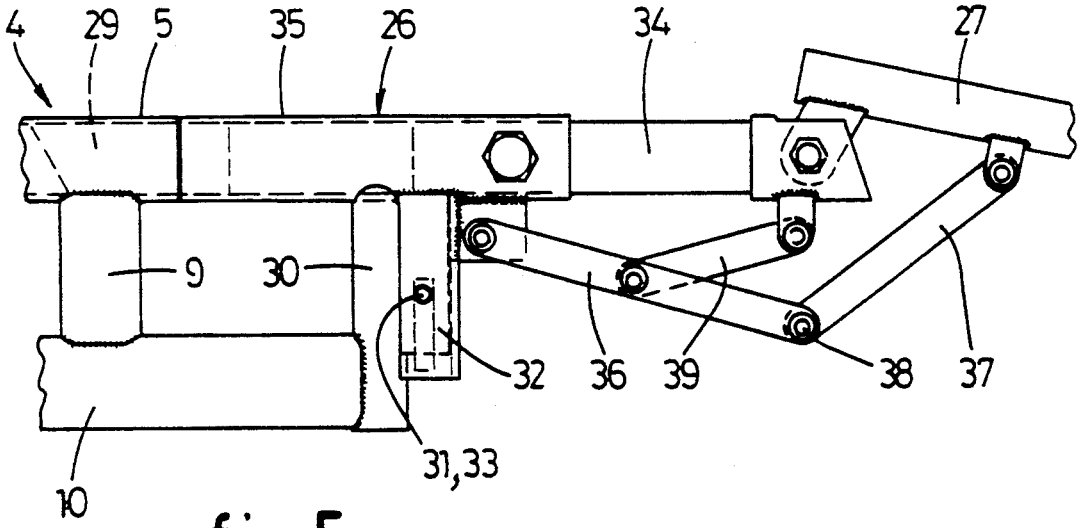
FIG. 5 shows a side view of the coupling part and the carrier of a foot support, wherein the coupling part is coupled with the seat frame section and the carrier is pivoted upwardly.

The wheelchair comprises at both sides a foot support 25, only one of which is shown in FIG. 1. This foot support 25 is detachably coupled with the seat frame section 4 as shown in FIGS. 4 and 5 in more detail. To this end the foot support 25 comprises a coupling part 26 and a carrier 27 for a foot support plate 28. This carrier 27 can also be provided with a leg support plate not shown.

The coupling part 26 comprises a protruding tube section 29 which can be slided into the corresponding upper side rod 5 of the seat frame section 4 as shown in FIG. 4. The lower side rod 10 carries a vertical support 30 with springy lock pin 31, which support 30 can be received partially fittingly in a coupling piece 32 of the coupling part 26, which coupling piece 32 has an opening 33 in to which the lock pin 31 clicks.

At the end opposite of the tube section 29 the carrier 27 is pivotly connected with a sliding element 34 of the coupling part 26. This sliding element 34 is slidable in a tube 35 of the coupling part 26. Between this tube 35 and the carrier 27 two bars 36, 37 are provided which are hingedly connected with each other on the one side at 38 and at the other side are rotatably connected with the tube 35 and the carrier 27, respectively. Further a bar 39 is provided which is connected rotatably on one side with the bar 36 and on the other side with the sliding element 34. In this manner it is obtained that during pivoting the carrier 27 upwardly the sliding element 34 slides out of the tube 35 in such a manner that the distance between the foot support plate 28 and the coupling part 26 or the seat frame section 4 increases, so that enough space is provided for the leg of the user of the wheelchair.

In this respect it is of importance that the bars 36, 37 and 39 are located at the lower side of the tube 35, so that this mechanism does not form an obstacle for the legs of the user of the wheelchair.

Figure 6:
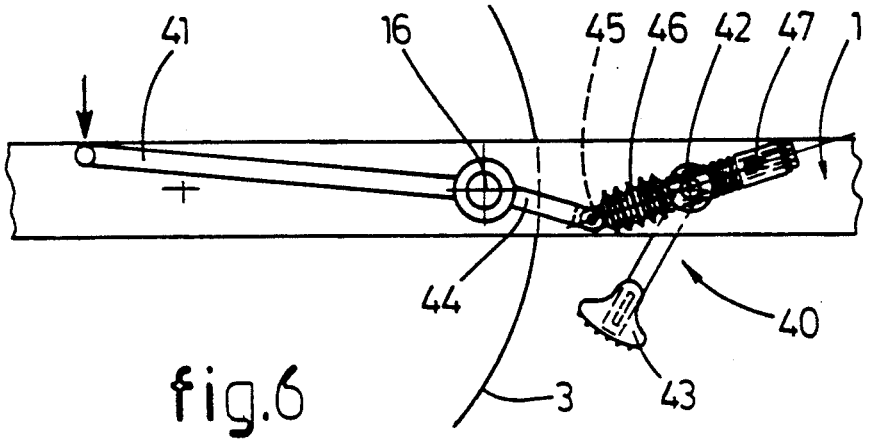
FIG. 6 schematically shows a side view of the brake of the wheelchair of FIG. 1, wherein the brake is in the inoperative position.

The wheelchair is provided with a brake 40 operable by means of a brake foot pedal 41 pivotably supported at the back side of the wheelchair by the base frame section 1, i.e. by the cross shaft 16. As shown in FIG. 6 and in more detail in FIG. 7, the brake 40 includes a shaft 42 rotatably mounted in the base frame section 1 and carrying on both sides of the base frame section 1 a brake block 43 adapted to cooperate with the corresponding rear wheel 3. The brake foot pedal 41 is provided with a lever 44 pivotably connected with a lever 45 of the shaft 42. A spring means 46 is provided between the free end of the lever 44 and the shaft 42. By operating the foot pedal 41 the brake blocks 43 can be moved from an inoperative position according to FIG. 6 into an operative position according to FIG. 7 and vice versa against the action of the spring means 46. The spring pressure can be adjusted by a bush 47 screwed in the shaft 42.

Figure 7:
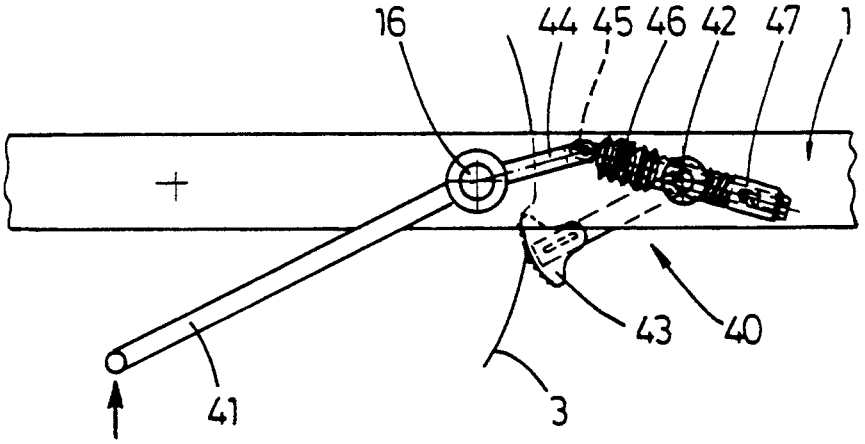
FIG. 7 shows a side view corresponding with FIG. 6, wherein the brake is in the operative position.

As appears from FIGS. 6 and 7, the levers 44, 45 enclose an obtuse angle in the operative and inoperative positions, wherein they pass a neutral intermediate position during the movement from the one position into the other position, in which the levers 44, 45 are in register.

It is noted that if desired it is possible to mount a lever on the shaft 42 for the manual operation of the brake 40.

The invention is not restricted to the above-described embodiment which can be varied in a number of ways within the scope of the invention.

I claim:

1. Wheelchair comprising a base frame section with four wheels and a seat frame section for supporting a seat and a back rest, wherein at both sides of the wheelchair front and back rods are pivotably connected with the base frame section and the seat frame section, wherein an adjusting means is mounted between both said frame sections for adjusting the seat angle between minimum and maximum values, wherein at the minimum seat angle the front and back rods are directed obliquely towards each other, wherein at the minimum seat angle the back rods enclose an angle with the vertical which is substantially greater than the angle enclosed between the front rods and the vertical, wherein the front rods pass the vertical when adjusting the seat angle from the minimum value to the maximum value.

2. The wheelchair of claim 1, wherein the adjusting means is formed by a gas spring with lock assembly for locking the gas spring in any position, said base frame section including a rotatable cross connection rod connecting said front rods with said base frame section, a support being attached to said rotatable cross connection rod, said support at the minimum seat angle being located at the same side of the vertical as said back rods, wherein a back cross rod is provided, said back cross rod being rotatably connected with said seat frame section, wherein one side of said gas spring is pivotally connected with said support and another side of said gas spring is connected with said back cross rod.

3. Wheelchair according to claim 2, wherein the back cross rod supports an operating element for operating the lock assembly of the gas spring, said operating element being operable by means of a foot pedal mounted on the base frame section at the back side of the wheelchair.

4. The wheelchair of claim 1, wherein there is a small upward movement of the front side of said seat frame section while obtaining a relatively large movement in the horizontal and forward direction when said seat frame section is adjusted between the minimum and maximum seat angle.

5. A wheelchair comprising a base frame section with four wheels and a seat frame section for supporting a seat and a back rest, wherein at both sides of the wheelchair, front and back rods are pivotally connected with the base frame section and the seat frame section, wherein an adjusting means is mounted between both said frame sections for adjusting the seat angle between minimum and maximum values, wherein at the minimum seat angle, the front and back rods are directed obliquely towards each other, wherein at the minimum seat angle the back rods enclose an angle with the vertical that is substantially greater than the angle enclosed between the front rods and the vertical, wherein the front rods pass the vertical when adjusting the seat angle from the minimum value to the maximum value, wherein the adjusting means is formed by a gas spring with lock assembly for locking the gas spring in any position, said base frame section including a rotatable cross connection rod connecting said front rods with said base frame section, a support being attached to said rotatable cross connection rod, said support at the minimum seat angle being located at the same side of the vertical as said back rods, wherein a back cross rod is provided, said back cross rod being rotatably connected with said seat frame section, wherein one side of said gas spring is pivotally connected with said support and another side of said gas spring is connected with said back cross rod, wherein the back cross rod supports an operating element for operating a lock assembly of said gas spring, said operating element being operable by means of a foot pedal mounted on said base frame section at the back side of the wheelchair.

* * * * *